US006243115B1

(12) United States Patent
Baker et al.

(10) Patent No.: US 6,243,115 B1
(45) Date of Patent: Jun. 5, 2001

(54) PRESSURIZED INK SUPPLY AND DELIVERY SYSTEM FOR AN INK JET PRINTER

(75) Inventors: Ronald Willard Baker, Versailles; Philip Jerome Heink; Jeffrey Lynn Richie, both of Lexington; Donald Wayne Stafford, Richmond, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/522,105

(22) Filed: Mar. 9, 2000

(51) Int. Cl.[7] ..... B41J 2/175
(52) U.S. Cl. ..... 347/85
(58) Field of Search ..... 347/85, 86, 87

(56) References Cited

U.S. PATENT DOCUMENTS

| | | | | |
|---|---|---|---|---|
| 4,558,326 | | 12/1985 | Kimura et al. | 347/30 |
| 4,575,738 | | 3/1986 | Sheufelt et al. | 347/96 |
| 4,734,711 | | 3/1988 | Piatt et al. | 347/17 |
| 4,982,200 | | 1/1991 | Ramsay | 347/86 |
| 5,446,486 | | 8/1995 | Reis | 347/85 |
| 5,453,770 | | 9/1995 | Katakura et al. | 347/85 |
| 5,719,609 | | 2/1998 | Hauck et al. | 347/85 |
| 5,757,390 | | 5/1998 | Gragg et al. | 347/7 |
| 5,870,124 | | 2/1999 | Silverbrook | 347/85 |
| 5,877,793 | | 3/1999 | Erickson | 347/85 |
| 5,877,795 | | 3/1999 | Gragg et al. | 347/92 |
| 6,030,074 | * | 2/2000 | Barinaga | 347/85 |

* cited by examiner

*Primary Examiner*—N. Le
*Assistant Examiner*—Anh T. N. Vo
(74) *Attorney, Agent, or Firm*—D. Brent Lambert, Esq.

(57) ABSTRACT

An ink supply and delivery system for a printer cartridge including a printer cartridge having an interior, at least one air inlet to the interior, and at least one ink outlet from the interior. An air pump is connected to the air inlet of the printer cartridge and creates a positive pressure in the interior of the printer cartridge. The system further includes an ink source, including ink, in the interior of the printer cartridge, the ink source in fluid communication with the ink outlet of the printer cartridge whereby the positive pressure created by the air pump in the interior of printer cartridge forces ink to flow from the ink source in the interior of the printer cartridge through the ink outlet. The ink source is preferably in a resilient container, and the system alternately includes a resilient air container either within, next to, or encapsulating the resilient container of the ink source. The printer cartridge alternately includes a vent to partially vent any accumulated pressure that has escaped from the resilient air container into the interior. There is further disclosed a method of supplying ink from a printer cartridge in a printer that prints upon a media, where the printer cartridge has an interior, at least one air inlet to the interior, and at least one ink outlet from the interior, with a positive pressure created in the interior of the printer cartridge from an air pump connected to the air inlet, and the printer cartridge further has an ink source, including ink, in the interior. The method preferably includes the steps of placing the printer cartridge into a printer, creating positive pressure in the interior of the printer cartridge through activation of the air pump, supplying ink from the ink source in the interior of the printer cartridge through the ink outlet, and printing on a media with the supplied ink.

19 Claims, 2 Drawing Sheets

PRESSURIZED INK SUPPLY AND DELIVERY SYSTEM FOR AN INK JET PRINTER

BACKGROUND OF THE INVENTION

1. Field of the Invention

The present invention generally relates to printers. More particularly, the present invention relates to the ink supply and delivery systems of printer cartridges for ink jet printers.

2. Description of the Related Art

Ink jet printers have historically placed the ink supply and the nozzle array in a single, disposable cartridge, which is inserted into the printer. While the design is simple, this arrangement results in a relatively high cost per printed page and shortens user intervention intervals as the cartridge must be frequently replaced. Moreover, these problems are particularly acute in ink jet printers that are used in network environments where the printer must be designed with greater ink capacities to lower the cost per page and lengthen the user intervention interval.

The placement of large quantities of ink on the moving printer cartridge carrier is not practical due to the excessive mass that has to be accelerated and controlled as the carrier traverses the media being printed upon. One typical solution to this problem is to provide stationary ink tanks mounted in the machine and then transport the ink through a fluid connection to the print head when needed for printing. The ink transport is thus typically accomplished by tubes connected between the ink tanks and the print head. Alternatively, some printers use a "dock and fill" approach in which the print head "docks" with the ink tanks and ink is transferred to "fill" the printer cartridge for use in printing.

With either of the above ink delivery systems, the provision of a controlled pressure to the ink is necessary in order to achieve the desired ink transfer in a reasonable time. Various techniques have therefore been used to pressurize the ink in the tanks to induce flow of the ink, but the known systems tend to be complex, costly, not independent of orientation, and do not provide constant pressure to the ink over the life of the printer. Therefore, an improved ink supply and delivery system for the printer cartridge that addresses and solves these problems would be advantageous. Accordingly, it is to the provision of such an improved ink supply and

SUMMARY OF THE INVENTION

The present invention is an ink supply and delivery system for a printer cartridge, which includes a printer cartridge having an interior, at least one air inlet to the interior, and at least one ink outlet from the interior. An air pump is connected to the air inlet of the printer cartridge, and the pump creates a positive pressure in the interior of the printer cartridge, the pressure either being confined to the interior or partially vented to the exterior. There is also an ink source, including ink, in the interior of the printer cartridge, and the ink source is in fluid communication with the ink outlet of the printer cartridge. In operation, the positive pressure created by the air pump in the interior of the printer cartridge forces ink to flow from the ink source in the interior of the printer cartridge through the ink outlet, and eventually to a print head for printing on a media.

In one embodiment, the printer cartridge is hermetically sealed such that the pressurized air can be collected within the interior of the printer cartridge to force ink from the ink source through positive air pressure exerted on the ink source. Alternately, the printer cartridge includes a vent to partially vent pressurized air from the interior of the printer cartridge.

The ink source is preferably a resilient container, such as a bag, in fluid communication with the ink outlet of the printer cartridge. In such an embodiment, the system preferably further includes a resilient air container in the interior of the printer cartridge and in fluid communication with the air inlet such that the air container expands from the positive pressure created from the air pump for forcing ink from the ink source through the ink outlet. The resilient air container can be contained within the resilient ink source container, can be next to the ink source container, or can encapsulate the ink source container.

The present invention further includes a method of supplying ink from a printer cartridge in a printer that prints upon a media, where the printer cartridge has an interior, at least one air inlet to the interior, and at least one ink outlet from the interior, and the printer cartridge further has positive pressure created in the interior from an air pump connected to the air inlet, and the printer cartridge also has an ink source included in the interior. The method includes the steps of placing the printer cartridge into a printer, creating positive pressure within the interior of the printer cartridge through activation of the air pump, supplying ink from the ink source in the interior of the printer cartridge through the ink outlet, and printing on a media with the supplied ink.

If the ink source is embodied as a resilient container, then the step of supplying ink from the ink source in the interior of the printer cartridge through the ink outlet is supplying ink from a resilient container in the interior of the printer cartridge and in fluid communication with the ink outlet. If the system includes an air container in the interior of the printer cartridge, then the step of creating positive pressure in the interior of the printer cartridge through activation of the air pump is preferably creating a positive pressure in a resilient air container in the interior of the printer cartridge, and the step of supplying ink from the ink source in the interior of the printer cartridge through the ink outlet is forcing ink from the interior through the ink outlet with expansion of the air container.

The several embodiments of the air container and ink source container relationship accordingly vary the step of creating positive pressure in the interior of the printer cartridge. If the resilient air container is within the ink source in the interior of the printer cartridge, then the step of creating positive pressure in the interior of the printer cartridge through activation of the air pump is creating a positive pressure in a resilient air container within the ink source in the interior of the printer cartridge. If the resilient air container encapsulates the ink source, then the step of creating positive pressure in the interior of the printer cartridge through activation of the air pump is creating a positive pressure in a resilient air container encapsulating the ink source in the interior of the printer cartridge.

When embodied with the resilient air container, the method preferably further includes the step of venting air from the interior of the printer cartridge through an air vent. Such venting prevents a deleterious pressurization from occurring in the interior of the printer cartridge.

The present invention therefore has a commercial advantage in that it provides an economical system for delivery of ink from the printer cartridge. The system has simple parts that can be installed in the printer as is it manufactured. Moreover, the system and method expands the ink carrying capacity of the printer cartridge with a minimum of wasted ink remaining unused in the printer cartridge.

Further, the present invention has industrial applicability as it is particularly advantageous for usage in printer cartridges for ink jet printers. The installation of the air pump and associated tubes into the ink jet printer as it is manufactured provides an adequate solution to the ink supply problems associated with ink jet printers as discussed above.

Other objects, features, and advantages of the present invention will become apparent after review of the hereinafter set forth Brief Description of the Drawings, Detailed Description of the Invention, and the claims.

DETAILED DESCRIPTION OF THE INVENTION

Figure 1:
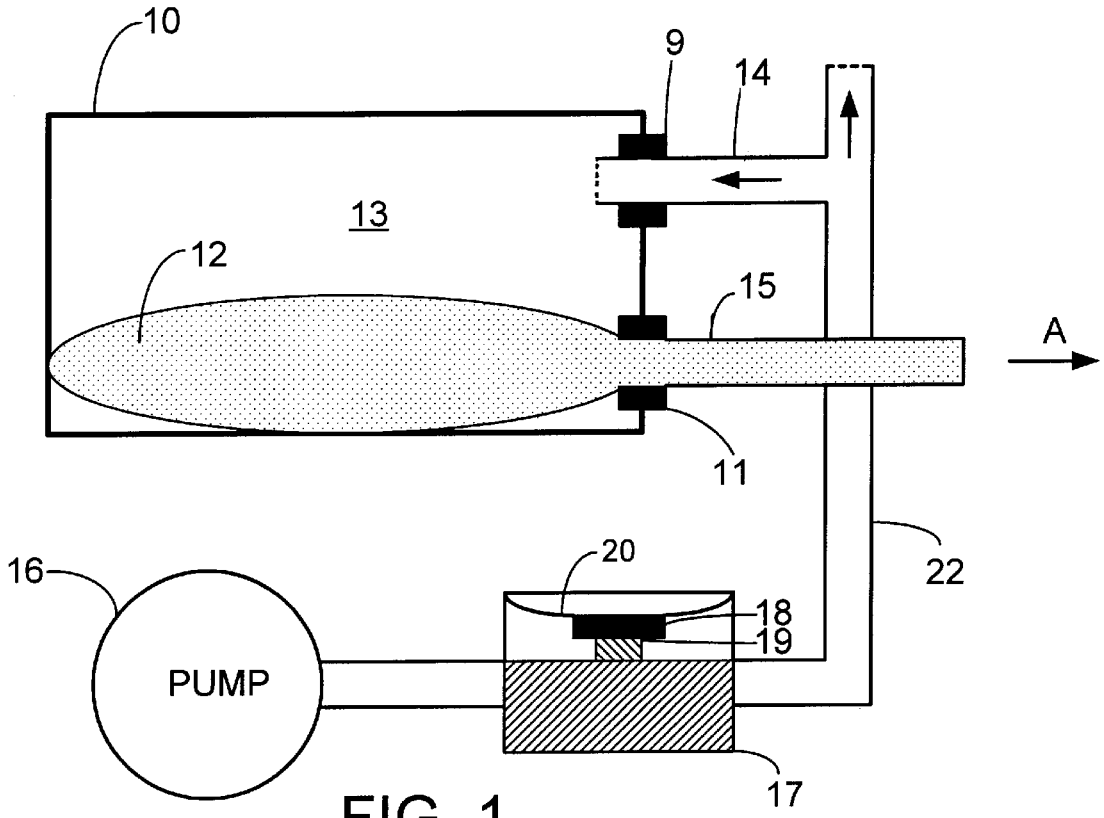
FIG. 1 is a representative diagram of the ink supply and delivery system with the printer cartridge shown in cross-section.

Referring now to the drawings in which like numerals represent like components throughout the several views, FIG. 1 illustrates an ink supply and delivery system for a printer cartridge 10 having an interior 13, at least one air inlet 9 to the interior 13, and at least one ink outlet 11 from the interior 13. An air pump 16 is connected to the air inlet 9 of the printer cartridge 10 through tube 14, and the air pump 16 creates a positive pressure in the interior 13 of the printer cartridge 10. Printer cartridge 10 is hermetically sealed in this embodiment with the air inlet 9 the only opening through which air can flow to the interior 13.

The printer cartridge 10 is illustrated herein as solely containing ink for use in the printer, however, the printer cartridge 10 can be alternately embodied as including other components, such as a print head (not shown), or toner for the printer. The printer cartridge 10 can also be embodied as a separate ink tank or ink cartridge that attaches within a printer separately from one or more other printer cartridges in the printer.

The printer cartridge 10 further has an ink source 12, shown here embodied as a bag, including ink in the interior 13 of the printer cartridge 10. The ink source 12 is a resilient container such that air pressure in the printer cartridge 10 can force collapse of the resilient container to drive ink therefrom and through the ink outlet 11. The ink source 12 is in fluid communication with the ink outlet 11 of the printer cartridge 10, and ink supply tube 15, which supplies ink ultimately to the print head of the printer (not shown). Accordingly, the positive pressure created by the air pump 16 in the interior 13 of printer cartridge 10 forces ink to flow from the ink source 12 through the ink outlet 11, and out through ink supply tube 15, in the direction of arrow A.

The ink source 12 as embodied herein preferably includes a needle/septum connection within the printer cartridge 10 such that the placement of the printer cartridge 10 into the printer pierces the ink source 12 to allow ink to flow. Another embodiment of the connection is to have a membrane or other temporary barrier across ink outlet 11 which prevents ink from leaking until a significant pressure is applied to the ink source 12 from the pressurized air in the interior 13, and at such time, the membrane or barrier ruptures to allow ink to flow from the ink source 12. Other methods and devices for allowing ink to flow from the ink source 12 as known in the art are alternately used.

The air pump 16 can be any pressure supplying device, such as a reciprocating piston pump, vane pump, peristaltic pump, centrifugal pump, diaphragm pump, or other compressor as known in the art. The air pump 16 is preferably connected along pressure air supply tube 22 to a pressure regulator 17 for the maintenance of a constant air pressure at the printer cartridge 10. The air supply tube 22 can be connected to one or more air inlets, such as air inlet 9, on one more printer cartridges, such as printer cartridge 10. The air pump preferably generates a static pressure in the range of 1 to 2 psig. The regulator 17 is particularly illustrated as containing an elastomeric seal 18 that rests upon a seat 19, where the seal 18 is pressed against the seat 19 with a spring 20 providing pressure against the seal 18. As the pump 16 moves air through the air supply tube 22, the pressure in the lines, tanks, and regulator increases. This pressure exerts a force against the seal 18 tending to lift it off the seat 19. Thus, at predetermined duration of operation of the pump 16, the force of the air pressure exceeds the force of the spring 20 and the seal 18 is slightly lifted off its seat 19, allowing some of the air to escape to the environment. This action therefore regulates the air pressure in the system to a maximum value determined by the design of the seal 18 and spring 20. Other pressure regulators as known in the art are alternately used between the pump 16 and the air inlet 9 to limit the acceptable pressure in the system.

Also, during printer cartridge 10 removal, air pressure relief preferably occurs before the ink connection is broken, such as at the needle/septum interface (not shown). Furthermore, pressure can be purposely bled from the system through the regulator 17 to insure safe installation and removal of the printer cartridge in the printer.

The regulator is preferably mounted in a printer between the pump and the printer cartridge 10, as shown in FIG. 1, or it is alternately mounted within the printer cartridge 10 itself. In addition, a solenoid or other suitable actuator can be attached to the regulator 17 to provide a controlled pressure release, either slow or sudden, for system shutdown, thus relieving pressure on the ink bags and ink lines when the printer is inactive. To accomplish the same purpose, a bleed orifice is alternately used in the pressurized air system, where the bleed orifice is simply a "controlled leak" which allows a small amount of air to continuously escape to the environment while the system is running. Upon shutdown, pressurized air continues to flow through the bleed orifice until most pressure within the system is relieved.

Figure 2:
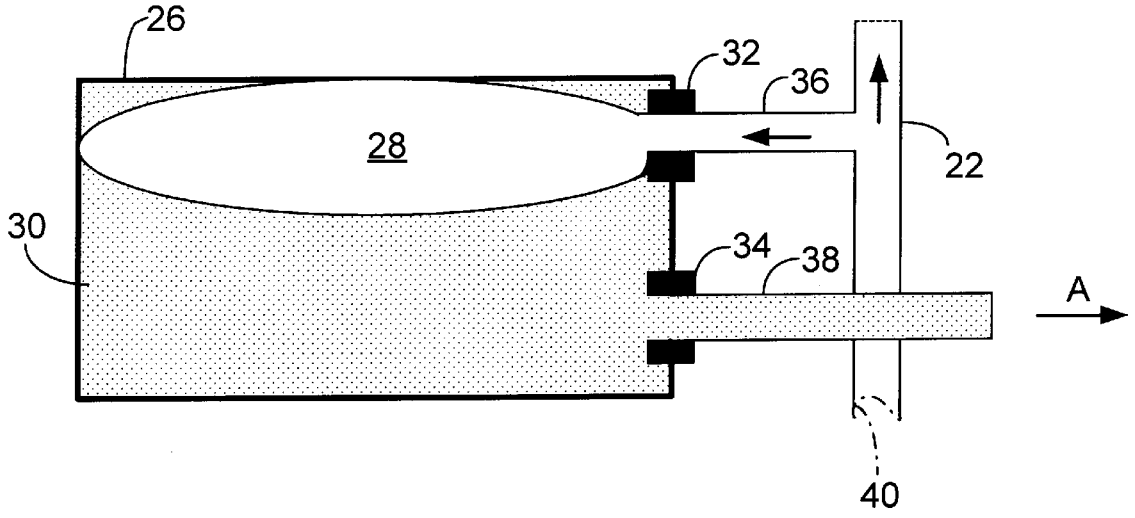
FIG. 2 is a cross-section of the printer cartridge illustrating a second embodiment of the ink source with a resilient air container in the interior of the printer cartridge.

FIG. 2 illustrates an alternate embodiment of the ink supply and delivery system with printer cartridge 26 having an interior 30 filled with ink, at least one air inlet 32 to a resilient air container 28, and at least one ink outlet 34 from the interior 13. The air pump 16 and regulator feed to the air supply tube 22 is represented at end 40. The air supply tube 22 is connected to the air inlet 32 of the printer cartridge 10 through tube 36, and the air pump 16 creates a positive pressure in the resilient air container 28 causing the container to expand and force ink from the interior. Printer cartridge 26 is also hermetically sealed in this embodiment such that the ink outlet 34 is the only opening through which the ink can flow, and the ink ultimately flows through ink supply tube 38, in the direction of arrow A.

Figure 3:
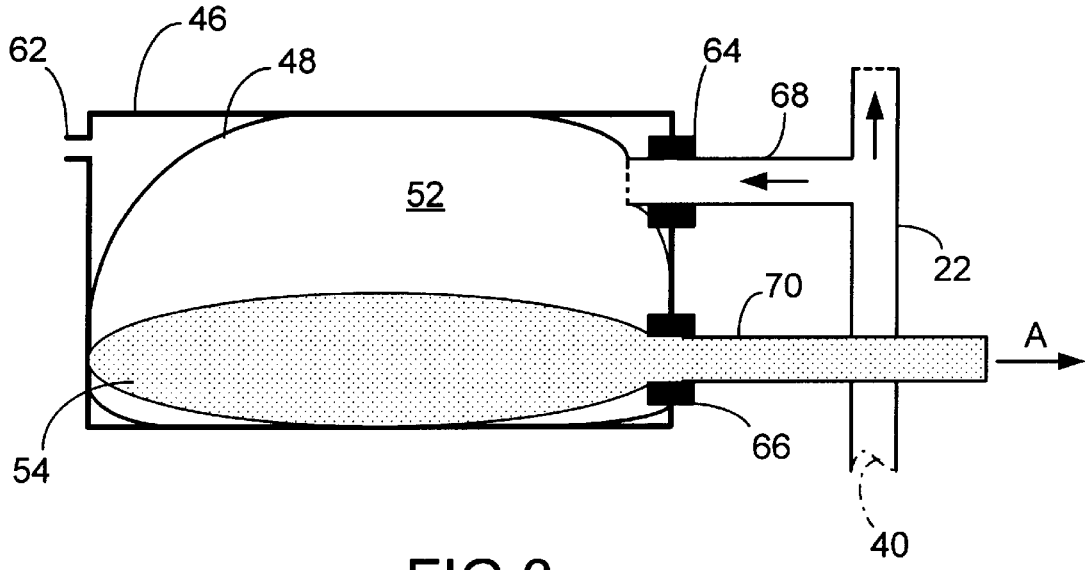
FIG. 3 is a cross-section of the printer cartridge illustrating a third embodiment of the ink source with a resilient air container in the interior of the printer cartridge encapsulating an ink source resilient container.

FIG. 3 illustrates a further alternate embodiment of the ink supply and delivery system with printer cartridge 46 having an interior 52 with a resilient air container 48 encapsulating an ink source resilient container 54. The resilient air container 48 is affixed to the air inlet 64, and the ink source resilient container 54 is affixed to the ink outlet 66. The printer cartridge 46 further includes an air vent 62 from the interior 52 of the printer cartridge 46 which prevents a significant build-up of pressure within the printer cartridge 46 as all pressure should be contained within the resilient air container 48.

The air supply tube 22 is connected to the air inlet 64 of the printer cartridge 46 through tube 68, and the air pump 16 creates a positive pressure in the resilient air container 48, causing the resilient air container 48 to expand, which places pressure on the ink source resilient container 54 to collapse. Thus, the pressure forces ink from the ink source resilient container 54, through the ink outlet 66, and through ink supply tube 70, in the direction of arrow A. This embodiment is particularly advantageous because it has the least amount of risk relative to the ink leaking from both the ink source resilient container 54 and the resilient air container 48.

Figure 4:
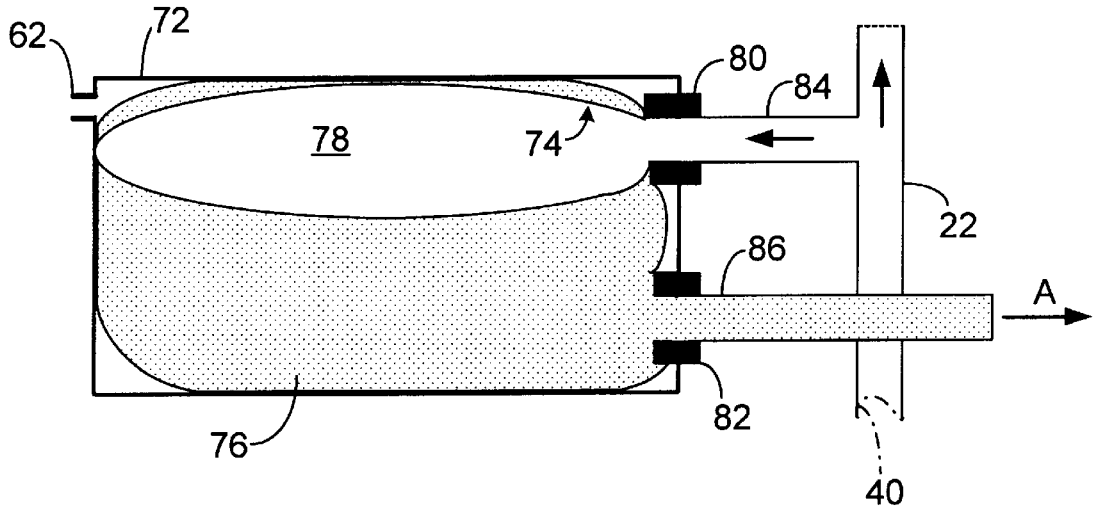
FIG. 4 is a cross-section of the printer cartridge illustrating a fourth embodiment of the ink source with a resilient air container in the interior of the printer cartridge within an ink source resilient container.

FIG. 4 illustrates yet a further embodiment of the ink supply and delivery system with printer cartridge 72 having an interior 78 with a resilient air container 74 within an ink source resilient container 76. The resilient air container 74 is affixed to the air inlet 80, and the ink source resilient container 76 is affixed to the ink outlet 82. The printer cartridge 72, likewise to the embodiment of FIG. 3, includes an air vent 62 from the interior 78 of the printer cartridge 72.

The air supply tube 22 is connected to the air inlet 80 of the printer cartridge 72 through tube 84, and positive pressure in the resilient air container 74 causes expansion, which places pressure on the ink source resilient container 54 that is bound by the printer cartridge 72. Thus, the expansion pressure forces ink from the ink source resilient container 76, through the ink outlet 82, and through ink supply tube 86, in the direction of arrow A.

It can thus be seen that the present inventive system provides a method of supplying ink from a printer cartridge in a printer that prints upon a media. With reference again to FIG. 1, the method includes the steps of: placing the printer cartridge 10 into a printer (not shown), and then creating positive pressure in the interior 13 of the printer cartridge 10 through activation of the air pump 16. The method then includes the steps of supplying ink from the ink source 12 in the interior 13 of the printer cartridge 10 through the ink outlet 11, and printing on a media (not shown) with the supplied ink as known in the art.

In the embodiments of FIGS. 1, 3, and 4, the step of supplying ink from the ink source 12 in the interior 13 of the printer cartridge 10 through the ink outlet 11 is supplying ink from a resilient container 12, 54, and 76 in the interior of the printer cartridge and in fluid communication with the ink outlet, such as ink outlets 11, 66, and 82. And in the embodiments of the printer cartridge in FIGS. 3 and 4, where the printer cartridge 46, 72 includes a vent 62 from the interior, the method further includes the step of venting air from the interior 52, 78 of the printer cartridge 46, 72 through an air vent 62.

Further, in the embodiments of the system as shown in FIGS. 2–4, which include a resilient air container 28, 48, and 74, the step of creating positive pressure to the interior of the printer cartridge 26, 46, 72 through activation of the air pump 16 is creating a positive pressure in a resilient air container 28, 48, 74 in the interior of the printer cartridge 26, 46, 72, the air container in fluid communication with the air inlet 32, 64, 80 and expanding from the positive pressure created from the air pump 16. And then the step of supplying ink from the ink source 30, 54, 76 in the interior of the printer cartridge 26, 46, 72 through the ink outlet 34, 66, 82 is forcing ink from the interior through the ink outlet 34, 66, 82 with expansion of the air container 28, 48, 74.

With reference again to FIG. 3, wherein the resilient air container 48 encapsulates the ink source resilient container 54, the step of creating positive pressure in the interior 52 of the printer cartridge 46 through activation of the air pump 16 is creating a positive pressure in a resilient air container 48 encapsulating the ink source 54 in the interior 52 of the printer cartridge 46, and the air container 48 is in fluid communication with the air inlet 64 expands from the positive pressure created from the air pump 16 to be bounded by the printer cartridge 46 itself. Accordingly, the step of supplying ink from the ink source 54 in the interior 52 of the printer cartridge 46 through the ink outlet 66 is forcing ink from the ink source 54 within the interior 52 through the ink outlet 66 with expansion of the resilient air container 48.

As particularly shown in FIG. 4, wherein the resilient air container 74 is within the ink source 76, the step of creating positive pressure in the interior 78 of the printer cartridge 72 through activation of the air pump 16 is creating a positive pressure in a resilient air container 74 within the ink source 76 in the interior 78 of the printer cartridge 72, where the air container 74 is in fluid communication with the air inlet 80 and expanding from the positive pressure created from the air pump 16. The step of supplying ink from the ink source 76 in the interior 78 of the printer cartridge 72 through the ink outlet 82 is likewise forcing ink from the ink source 76 within the interior 78 through the ink outlet 82 with expansion of the air container 74.

While there has been shown a preferred and alternate embodiments of the present invention, it is to be understood that certain changes may be made in the forms and arrangements of the components and steps of the inventive method without departing from the spirit and scope of the invention as set forth in the claims appended herewith. In addition, the corresponding structures, materials, and equivalents of all means-plus-function elements in the claims are intended to include any structure, material, or component as known to one of skill in the art for performing the function in combination with the other claimed elements.

What is claimed is:

1. An ink supply and delivery system for a printer cartridge, comprising:

a printer cartridge having an interior, at least one air inlet to the interior, and at least one ink outlet from the interior;

an air pump connected to the air inlet for creating a positive pressure in the interior of the printer cartridge;

an ink source including ink in the interior of the printer cartridge and in fluid communication with the ink outlet; and a resilient air container in the interior of the printer cartridge and in fluid communication with the air inlet, the air container expanding from the positive pressure created by the air pump for forcing the ink from the ink source through the ink outlet.

2. The system of claim 1, wherein the printer cartridge is hermetically sealed.

3. The system of claim 1, wherein the ink source is a resilient container in fluid communication with the ink outlet of the printer cartridge.

4. The system of claim 3, wherein the ink source is a bag.

5. The system of claim 3, wherein the printer cartridge further includes an air vent from the interior of the printer cartridge.

6. The system of claim 3, wherein the air container is positioned within the ink source container.

7. The system of claim 3, wherein the air container encapsulates the ink source container.

8. The system of claim 7, wherein the resilient air container is a bag.

9. An ink supply and delivery system for a printer cartridge, comprising:

a printer cartridge having an interior, at least one air inlet to the interior, and at least one ink outlet from the interior;

a pressure supply means for creating a positive pressure in the interior of the printer cartridge, the pressure supply means connected to the air inlet of the printer cartridge;

an ink supply means for supplying ink from the printer cartridge, the ink supply means including ink in the interior of the printer cartridge and being in fluid communication with the ink outlet of the printer cartridge; and a resilient air containing means in the interior of the printer cartridge and in fluid communication with the air inlet, the air containing means expanding from the positive pressure created by the pressure supply means for forcing the ink from the ink supply means through the ink outlet.

10. The system of claim 9, wherein the printer cartridge is hermetically sealed.

11. The system of claim 9, wherein the ink supply means is a resilient container in fluid communication with the ink outlet means of the printer cartridge.

12. The system of claim 11, wherein the printer cartridge further includes an air vent for venting air from the interior of the printer cartridge.

13. The system of claim 11, wherein the air containing means is positioned within the ink supply means.

14. The system of claim 11, wherein the air containing means encapsulates the ink supply means.

15. A method of supplying ink from a printer cartridge in a printer that prints upon a media, the printer cartridge having an interior, at least one air inlet to the interior and at least one ink outlet from the interior, the printer cartridge having a positive pressure created in its interior by an air pump connected to the air inlet, the printer cartridge further having an ink source including ink in the interior, the method comprising the steps of:

placing the printer cartridge into the printer;

creating the positive pressure in a resilient air container in the interior of the printer cartridge through activation of the air pump, the air container being in fluid communication with the air inlet and expanding from the positive pressure created by the air pump;

supplying the ink from a resilient container as the ink source in the interior of the printer cartridge, the ink container being in fluid communication with the ink outlet by forcing the ink through the ink outlet with the expansion of the air container; and printing on the media with the supplied ink.

16. The method of claim 15, further including the step of venting air from the interior of the printer cartridge through an air vent.

17. The method of claim 15, wherein the resilient air container is positioned within the ink source in the interior of the printer cartridge for forcing the ink from the interior of the printer cartridge through the ink outlet.

18. The method of claim 15, wherein the resilient air container encapsulates the ink source in the interior of the printer cartridge for forcing the ink from the interior through the ink outlet.

19. The method of claim 15, wherein the step of placing the printer cartridge into a printer comprises placing the printer cartridge into an ink jet printer.

* * * * *